US007805973B2

(12) United States Patent
Bosga et al.

(10) Patent No.: US 7,805,973 B2
(45) Date of Patent: Oct. 5, 2010

(54) MECHANICAL PRESS DRIVE SYSTEM

(75) Inventors: Sjoerd Bosga, Västerås (SE); Falah Hosini, Västerås (SE); Marc Segura Golorons, Barcelona (ES)

(73) Assignee: ABB Research Ltd., Zürich (CH)

( * ) Notice: Subject to any disclaimer, the term of this patent is extended or adjusted under 35 U.S.C. 154(b) by 0 days.

(21) Appl. No.: 12/278,386

(22) PCT Filed: Apr. 4, 2006

(86) PCT No.: PCT/SE2006/050055

§ 371 (c)(1),
(2), (4) Date: Dec. 1, 2008

(87) PCT Pub. No.: WO2007/091935

PCT Pub. Date: Aug. 16, 2007

(65) Prior Publication Data

US 2009/0217724 A1 Sep. 3, 2009

Related U.S. Application Data

(60) Provisional application No. 60/765,182, filed on Feb. 6, 2006.

(51) Int. Cl.

| | |
|---|---|
| ***B21J 9/18*** | (2006.01) |
| ***B21J 7/46*** | (2006.01) |
| ***B30B 15/16*** | (2006.01) |
| ***B30B 15/14*** | (2006.01) |

(52) U.S. Cl. ..... 72/452.5; 72/443; 72/29.2; 100/48; 100/52

(58) Field of Classification Search ..... 72/452.5, 72/441, 443, 28.1, 29.2, 20.2, 21.2; 100/43, 100/48, 52

See application file for complete search history.

(56) References Cited

U.S. PATENT DOCUMENTS 3,187,600 A * 6/1965 Seybold ..... 74/393

(Continued)

FOREIGN PATENT DOCUMENTS

| | | | |
|---|---|---|---|
| DE | 884278 | C | 7/1953 |
| DE | 905700 | C | 3/1954 |
| DE | 4421527 | A1 | 12/1995 |
| DE | 10358991 | A1 | 7/2004 |

(Continued)

OTHER PUBLICATIONS

Dennis Boerger; High-tech presses, Servo technology meets mechanical presses, Stamping Journal, Nov. 2003.
PCT/ISA/210—International Search Report—Oct. 11, 2006.
PCT/IPEA/409—International Preliminary Report on Patentability—Feb. 6, 2006.

*Primary Examiner*—Dana Ross
*Assistant Examiner*—Mohammad Yusuf
(74) *Attorney, Agent, or Firm*—Venable LLP; Eric J. Franklin

(57) ABSTRACT

A method for operating a mechanical press including an electric drive motor, a drive control for controlling the motor, a ram, a flywheel, a clutch and a member for translating rotational motion of the flywheel in a first rotation direction into a linear motion of the ram arranged to be lowered and raised along a linear path for operating the press to carry out a press production cycle. The press cycle includes a pressing part and one or more non-pressing parts. The press includes a second drive motor or actuator arranged connected to the ram and by providing a control output to the drive control, the speed of the second drive motor is made variable during at least one part of the press production cycle. The press may be reversed between production cycles. A press and system including such a press.

46 Claims, 11 Drawing Sheets

U.S. PATENT DOCUMENTS

| | | | | |
|---|---|---|---|---|
| 5,069,060 | A * | 12/1991 | Ishii | 72/443 |
| 5,588,344 | A | 12/1996 | Chun | |
| 6,242,877 | B1 | 6/2001 | Irwin et al. | |
| 6,443,867 | B1 | 9/2002 | Fahrenbach | |
| 6,520,077 | B1 | 2/2003 | Minagawa et al. | |
| 6,619,088 | B1 | 9/2003 | Oyamada et al. | |
| 2004/0003729 | A1 | 1/2004 | Aoshima | |
| 2004/0240981 | A1 | 12/2004 | Dothan et al. | |

FOREIGN PATENT DOCUMENTS

| | | | |
|---|---|---|---|
| EP | 0434632 | A2 | 6/1991 |
| EP | 0561604 | A1 | 9/1993 |
| EP | 1126581 | A2 | 8/2001 |
| EP | 1281508 | A | 2/2003 |
| EP | 1640145 | A | 3/2006 |
| GB | 2258186 | A | 2/1993 |
| JP | 8108229 | A | 4/1996 |
| JP | 20011191134 | A | 7/2001 |
| WO | WO-2004056559 | A | 7/2004 |

* cited by examiner $W_{27}$
speed
Wp
time
UC
BDC
I
DP
P
$T_2$

20, Wf
22, $W_{27}$
ΔT2
W1
speed
Wp
time
UC
BDC
I
DP
P
$T_{2servo}$

MECHANICAL PRESS DRIVE SYSTEM

CROSS-REFERENCE TO RELATED APPLICATIONS

This application claims priority to U.S. provisional patent application 60/765,182 filed 6 Feb. 2006 and is the national phase under 35 U.S.C. §371 of PCT/SE2006/050055 filed 4Apr. 2006.

TECHNICAL FIELD

The invention concerns a mechanical press of the type used for pressings, stamping or punching of metal parts from blanks. In particular, the invention discloses a mechanical press driven at least in part by an electric motor with an improved system of controlling transmission of power from a drive system to the ram of the press.

TECHNICAL BACKGROUND

Mechanical presses are commonly used to produce stamped car parts from steel blanks. Today's large mechanical presses are driven by a flywheel. The function of the flywheel is to store the necessary energy to carry out a pressing operation. A motor drives the flywheel so that before the start of a press operation the flywheel is rotating at the speed at which the pressing will occur. A schematic diagram for a typical mechanical press with a flywheel is shown in FIG. 2 (Prior Art). To start the press operation, a clutch is engaged, which connects the press (until then standing still) to the flywheel. The press then rotates at constant speed until the moment of impact between the press die and the blank. While pressing a part, the speed of the press and flywheel drop to a lower speed.

A schematic diagram shows a diagram for typical speed profile in FIG. 3 (Prior Art). When pressing is completed, the press continues to rotate until its eccentric wheel has rotated one complete turn. During this second part following pressing, the motor driving the flywheel will slowly increase the rotational speed to regain the normal pressing speed. At the end of the operation, the clutch is disengaged and a brake is used to stop the motion of the press.

In addition, once setup to run with a given die, the working cycles of traditional motor driven presses, link presses and similar are fixed. For example once the speed of the flywheel is set and the clutch engaged, the press will move following a fixed pattern, such as that of FIGS. 3, 7*a* (Prior Art) repeated as many times as required. In the traditional mechanical solution, press speed is fixed and proportional to flywheel speed during the complete operation. Thus, if pressing has to be done at a low speed (for quality reasons), the complete operation will occur at low speed. This results in a long cycle time, and therefore, a low production rate.

Servo presses, such as presses disclosed in patent application U.S. 60/765,183, sometimes described as having a Direct Drive Chain configuration, do not have a large flywheel and a clutch. A servo motor drives the press directly. At the start of the operation, the motor accelerates the press to a high speed, higher than the pressing speed. Then, before impact, the motor slows down the press to pressing speed. Pressing thus occurs at the same speed as with the mechanical solution. As soon as pressing is completed, the motor once again accelerates the press to high speed. When the press has opened sufficiently for the unloader robot to enter the press, the motor starts slowing down the press.

The servo press can thus reach a much improved cycle time at low pressing speeds, because of its capability to run at a high speed during the rest of the cycle. However, the servo press requires a large motor and power converter (approx. five times larger than the fully mechanical press). For the servo press to operate at low pressing speeds, additional inertia such as in the form of a small flywheel may be added to the motor/press. Although much smaller than the flywheel in the fully mechanical solution, this inertia or small flywheel requires high peak power and transfer of a large amount of energy to accelerate and decelerate. Providing this peak power and energy requires a large rectifier and a robust grid connection, or some form of electrical energy storage.

DE4421527 (1994) adds a second drive motor to the press, a controlled induction machine, which second motor is mounted on the opposite end of the shaft to which the flywheel is connected. Peak power from the grid is reduced by using the main motor (also an induction machine) as a generator while accelerating the press, and storing the braking energy recovered by motor 2 in the flywheel by means of motor 1. The second motor is used to bring the press up to flywheel speed, and is not used during the pressing stage.

It is known from the publicity material of Aida-America Corporation to drive a mechanical press using a servo motor with a direct drive to the slide mechanism (Ref 1.) This type of servo press with a direct drive has the advantage of requiring no flywheel, clutch or brake and having a programmable slide motion. However, servo motor presses may have a high peak power consumption for some products, for example products requiring deep drawing.

SUMMARY OF THE INVENTION

According to one or more embodiments of the present invention an improvement is provided to methods for operating a mechanical press comprising an electric drive motor, a drive control means for controlling the motor, a flywheel, a clutch, a brake, a press ram, an eccentric member or other member for translating rotational motion of said flywheel to linear motion of said ram arranged to be lowered and raised along a linear path for operating said press, and by means of a second drive motor or actuator provide drive to the press ram wherein the speed of the second drive motor is varied during at least one part of a said press production cycle.

According to another aspect of an embodiment of the invention improvements are provided in the form of a method for a mechanical press wherein the speed of the second drive motor or actuator during the at least one part of a press production cycle is controlled to vary and may be greater than the speed of said second drive motor or actuator during said pressing part of the press production cycle.

According to another embodiment of the invention improvements are provided in the form of a method for a mechanical press wherein the speed of the second drive motor or actuator during the at least one part of a press production cycle is controlled to vary and drive the ram via a member at speeds which may be greater than the speed of the ram during said pressing part of the cycle.

According to another embodiment of the invention improvements are provided in the form of a method for a mechanical press wherein the speed of the second drive motor or actuator during the at least one part of a press production cycle is controlled to vary and drive the eccentric or other member at speeds which may be greater than the speed of the eccentric during said pressing part of the cycle.

According to another embodiment of the invention improvements are provided in the form of a method for a mechanical press comprising providing a control output to said drive control means wherein the speed of the second drive motor between the start of said press cycle and said pressing part of the cycle is variably controlled and reaches a speed greater than the speed of same said second drive motor during said pressing part of the cycle.

According to another aspect of an embodiment of the invention improvements are provided in the form of a method for a mechanical press comprising providing a control output to said drive control means wherein the speed and rotational direction of the second drive motor is controlled such that the press cycle is carried out in a first rotation direction and may extend over more than 360 degrees of crank angle rotation.

According to another aspect of an embodiment of the invention improvements are provided in the form of a method for a mechanical press comprising providing a control output to said drive control means wherein the speed and rotational direction of the second drive motor is controlled such that the press cycle is carried out in a first rotation direction and comprises reversing the second drive motor during each press cycle.

According to another aspect of an embodiment of the invention improvements are provided in the form of a method for a mechanical press comprising a second drive motor and by providing a control output to said drive control means wherein said second drive motor is accelerated from a start up position of less than 0 degrees, or before Top Dead Centre (TDC), and drives said press through greater than 360 degrees and may pass through TDC twice during a press cycle in the first rotation direction.

According to another aspect of an embodiment of the invention improvements are provided in the form of a method for a mechanical press comprising a second drive motor and by providing a control output to control said second drive motor to accelerate during a first part of the press cycle and before a ram position equivalent to a die protection (DP) angle relative the press cycle to a speed which may be in excess of the pressing speed.

According to another aspect of an embodiment of the invention improvements are provided in the form of a method for a mechanical press comprising providing a control output to said drive control means wherein the speed of the second drive motor is reduced from a maximum speed to a pressing speed prior to the position of first impact between the die and the blank.

According to another embodiment of the invention improvements are provided in the form of a method for a mechanical press comprising providing a control output to said drive control means wherein the second drive motor or actuator speed is variably controlled to bring the press to a standstill at Bottom Dead Centre (BDC) or thereabouts for a period of time.

According to another embodiment of the invention improvements are provided in the form of a method for a mechanical press comprising providing a control output to said drive control means wherein the second drive motor speed is variably controlled to increase upon reaching Bottom Dead Centre (BDC) or thereabouts.

According to another aspect of an embodiment of the invention improvements are provided in the form of a method for a mechanical press comprising decelerating the second drive motor from a deceleration position in the press cycle relative to an unload cam (UC) angle of the press cycle.

According to another embodiment of the invention improvements are provided in the form of a method for a mechanical press comprising providing a control output to said drive control means wherein the second drive motor or actuator speed is variably controlled to slow the press down upon reaching Unload Cam (UC) or thereabouts for a period of time for synchronization purposes and re-accelerate the press before reaching the Die Protect (DP) position or thereabouts.

According to another aspect of an embodiment of the invention improvements are provided in the form of a method for a mechanical press comprising decelerating the second drive motor in the first direction while driving said press to a position with a crank angle of greater than 360 degrees or twice past TDC.

According to another embodiment of the invention improvements are provided in the form of a method for a mechanical press comprising providing a control output to said drive control means to move said ram to a cycle start position for each press cycle which is a plurality of degrees of crank angle backwards in the second rotation direction when compared to the travel of a press cycle in the first rotation direction.

According to another embodiment of the invention improvements are provided in the form of a mechanical press comprising an electric drive motor, a drive control means for controlling the motor, a press ram, a rotating shaft, and a member for translating rotational motion of said motor to linear motion of said press ram arranged to be lowered and raised along a linear path for operating said press, wherein said press is arranged with a second drive motor or actuator which is arranged for variable speed and control and with means to drive the eccentric or other drive member at a speed greater than the speed during pressing.

According to another embodiment of the invention improvements are provided in the form of an improved mechanical press arranged with a second drive motor, wherein said drive control has means arranged to control the motor to provide a complete press cycle comprising a rotation of a member for translating rotational motion in a first rotation direction of greater than 360 degrees, and that means such that the rotation direction of said motor is arranged to be reversible.

According to another aspect of an embodiment of the invention improvements are provided in the form of a mechanical press arranged with a second drive motor and further comprising computer program or software means arranged for reversing the rotational direction of the motor during a press cycle in the first direction.

According to another aspect of an embodiment of the invention improvements are provided in the form of a mechanical press comprising a second drive motor and where said press comprises position sensor means for determining an eccentric rotation angle, a crank rotation angle or a linear position of the ram in the press.

According to another embodiment of the invention improvements are provided in the form of a mechanical press comprising a second drive motor where said press may comprise sensor means comprised in the second drive motor for determining a position or speed of a shaft of the motor.

According to another embodiment of the invention improvements are provided in the form of a mechanical press comprising a second drive motor or actuator where said press may comprise means in said control means or in a control unit for measuring or otherwise determining the speed of said second drive motor or actuator.

According to another embodiment of the invention improvements are provided in the form of a mechanical press comprising a second drive motor or actuator where said press may comprise means associated with a first and/or a second drive motor, or in a control unit, for measuring or otherwise determining the speed of said first and/or second drive motor or actuator.

According to another embodiment of the invention improvements are provided in the form of a mechanical press comprising a second drive motor or actuator where said press may comprise control means for operating a clutch and coupling a flywheel to the eccentric or other drive member of said press during one or more parts of a press cycle.

A disadvantage of today's large mechanical presses is that production speed of a pressed or stamped part is limited by the fixed speed profile of the actual pressing process. This limitation has been reduced by the introduction of a servo press, which also eliminates the need for the expensive clutch and brake. However, the servo press requires a large motor and power converter, perhaps up to five times larger than that of a converter for the fully mechanical press. The servo press may then require large investments to establish a robust grid connection or else an electrical energy storage device.

Instead of this, a second motor and converter can be added to the mechanical press. The most important function of the second motor is to drive the press during that/those part(s) of the cycle where the press is not actually pressing. For the actual pressing stage, the flywheel may still be used as today. The clutch and brake, while still needed, may be much simpler and cheaper than in today's mechanical press. This solution achieves the performance of the servo drive press type without the need for very large electrical power installations. The solution is especially suited as an add-on, retrofit or refurbishment option for existing presses.

A principle drawing of the proposed solution is described in detail below. Summarily it may be described that as in the fully mechanical traditional prior art solution, an electric drive motor drives a flywheel. The size of this flywheel is identical or somewhat smaller than in the prior art fully mechanical solution. The flywheel is rotated so as to provide the desired pressing speed. A second motor or actuator is arranged connected to the press. This drive motor has approximately the same size as the first motor. At the place where in the fully mechanical prior art solution a clutch is mounted, a clutch function is also present in the improved press. However, in the proposed solution this clutch has in principle only to operate when the speeds at both sides of the clutch are equal. This clutch, which is thus more of a coupling than a clutch, is thus much simpler and cheaper than the clutch in the fully mechanical prior art solution.

At the start of an operation, the press is standing still, the flywheel is rotating at pressing speed, and the clutch or coupling is disengaged. To start the press production cycle, the second motor brings the press up to a high speed, for example up to 20-30% higher than the normal maximum pressing speed of the press. Then, before reaching the point of impact, the second motor slows the press down to the desired pressing speed. If required one or both of the first or second drive motor may be controlled so as to synchronise speed with the other motor. Before the moment of impact between workpiece and die, the coupling or simple clutch to the flywheel is engaged.

While pressing the workpiece, the flywheel delivers energy to the pressing process. At the same time, if so required, one or both motors can deliver torque, helping the flywheel to maintain the pressing speed.

As soon as pressing is completed, i.e. when the press passes bottom dead center or thereabouts, the clutch or coupling to the flywheel is disengaged. The second motor then accelerates the press back up to a high speed. At the same time, the first motor may gradually accelerate the flywheel back to normal pressing speed, up till the start of the pressing stage of the next press production cycle.

The second motor maintains the press at high speed until at the unload-cam angle or thereabouts. It will then slow down the press at the end of the press cycle, for example to a standstill. Thus, the control of the second motor has certain similarities with control of a servo press with at least the exception of the synchronization to the flywheel speed before engaging the coupling or clutch. At the time when the clutch is disengaged ideally no torque should be present across the clutch.

A servo press according to patent application U.S. 60/765,183, hereby incorporated in full by means of this reference, has the option of operating in bi-directional mode—i.e. the first operation starts before top dead center and ends after top dead center, and after that the press performs the same operation in the opposite direction. This method allows a reduction in the size of the servo motor. The second drive motor or actuator solution described here is not suitable for use in a bi-directional operation if using a standard clutch in a normal flywheel press design. This is because the press becomes directly linked to the flywheel which always turns in the same direction from one operation to the next. Thus an additional reversing gear mechanism would be required for fully bi-directional operation. However, the improved press can carry out a method called "alternative bi-directional operation". In this method, the press cycle starts before top dead center, and ends after top dead center. Then, before starting the next press cycle, the press moves backwards to its previous starting point. This control method allows the size of the second motor or actuator and its associated converter to be reduced.

The flywheel in the proposed solution can be somewhat smaller than in the fully mechanical prior art solution, due to three reasons. Firstly, no energy is lost in the clutch. In the fully mechanical solution, every time the press is started, the flywheel speed shows a slight drop due to energy losses in the clutch. Secondly, while pressing the second motor can also provide torque to the press, so that less energy is needed from the flywheel. Finally, as the second motor provides a short cycle time, a larger speed drop while pressing may be allowed.

If required, peak power taken from the grid may be reduced by taking the energy required for acceleration of the press only partly from the grid, or even not directly at all when the first drive motor is used in part as a generator, taking energy from the flywheel. At the end of the operation, energy regenerated by the second motor during deceleration can be fed back to the flywheel instead of to the grid (using the first motor). However, to reduce peak power taken from the grid it may be necessary in addition to limit the power of the first motor and the second motor while pressing—which may result in a slight increase in production cycle time. During any slowing or braking part of the press cycle energy may be stored in the flywheel via the first motor.

For a topology in which a single rectifier is used to create a dc-link voltage for the two motors, the case where energy regenerated by the second motor is stored in the flywheel instead of being fed back to the grid, the rectifier does not need to be able to supply energy back to the grid, i.e. it has the additional advantage that a simpler diode rectifier could be used.

As a different topology, potentially better suited for application of the invention on existing installations, the inverter for the second motor may be supplied by a separate rectifier.

In a different embodiment, the clutch or coupling can be of a type that requires not only that both sides are at the same speed when the clutch is engaged, but also that there is a fixed relation between the position of the two sides. The control of the second drive motor can be programmed to synchronize not only speed but also position. Depending on the required accuracy this may or may not require additional sensors. This may or may not require sensors at the clutch to synchronize speed and/or position.

More than one second motor or actuator may be added to a flywheel press, especially for more complex press designs in which there are a plurality of transmission mechanisms, multiple eccentric wheels and or cranks, for example. Multiple motor arrangements, i.e. more than one first motor and/or more than one second motor may be arranged in different dedicated or shared converter or rectifier topologies.

The principal advantage of the improved press is that the motor speed may be variably controlled during a press cycle to achieve a shorter cycle time. This allows a degree of control and operational accuracy that is not available in todays mechanical presses flywheel presses. The advantage gained is that the total time for a press production cycle may be reduced compared to a production cycle time for an equivalent mechanical, flywheel-type press of the prior art.

Advantages of the improved press with a second drive motor or actuator compared to a traditional mechanical flywheel press include:

- speed control of the press while not pressing allows substantially shorter cycle time up to 30% higher production rate for presses operating at low speed, and up to 10% for presses operating at high speed:
- speed control of the press (servo operation) while not pressing allows improved synchronization with loader/unloader (robots);
- no brake is needed (except for a smaller emergency brake);
- much lower stress on press while starting and stopping:
- more synchronization options with unloader and loader robots;
- potentially lower energy consumption (no losses in clutch and brake);
- much simpler clutch, thus cheaper to build and maintain;
- reduced wear in the clutch, reduced maintenance and improved up-time;
- flywheel may be somewhat smaller depending on a tradeoff between flywheel size and motor size.

Advantages of the improved press with a second drive motor or actuator compared to a servo press:

- lower peak power from grid;
- smaller converter can be used;
- smaller second motor (motor 2) or actuator;
- large flywheel, brake and clutch or coupling are needed, as in fully mechanical solution with known proven technology;
- if required the press may be run with the second motor disabled or disconnected as a production backup measure;
- can be added to an existing press.

The proposed hybrid drive chain for presses is also advantageous as an upgrade to existing presses. The existing flywheel and clutch can be kept in place, and the brake can either be kept or removed. Both flywheel and clutch will then be somewhat over-dimensioned, but this will affect performance and lifetime positively. For a relatively small investment (one motor, control system and converter), the existing press has a much improved performance.

For new press lines as well as for complete refurbishments of existing press lines, the all-servo press of U.S. 60/765,183, is still advantageous, provided that a cost effective solution is found to supplying the required peak power and energy to the servo motor.

Typically the main advantage is a shortened production cycle time. However the speed of the motor may also be varied as necessary during any press production cycle and also meet as required, a constraint that the pressing time and cycle time between loading-pressing-unloading does not vary. Thus there are other advantages of the invention which may include:

- Controllability: while a preset motion would be appropriate during the stamping process part of a press cycle, a control may be applied during the rest of the motion cycle,
- increased speed during opening/closing the press (while for example maintaining original speed during the stamping part of the cycle), resulting in reduced cycle times,
- a lower pressing speed may be used while maintaining the same production cycle time as a traditional press or shorter, to improve quality and reduce audible noise, vibration and stress,
- reduces the necessity for hydraulic presses and presses with complicated link systems, as the inventive hybrid motor drive system provides better controllability, more flexibility and reduced setup times.

In addition tryouts can be performed on the actual line. For example, slow or gradual press motion such as micro-inching a press during a setup or maintenance operation is easily achieved by means of the variable motor speed control.

Another important advantage is that motion of the inventive hybrid mechanical press may be adapted to the operation of other machines involved in a production sequence. Motion may be optimised in relation to other machines in a production sequence when for example blanks are loaded in the press and/or stamped parts unloaded from the press by transfer devices or other automated devices. Such other machines in the production sequence may be one or more robots. Controlling the press in synchronisation with control of the feeding by automatic feeders, other feeders, robot loaders/unloaders, etc provides the advantage of synchronization of feeder/loader motion and press motion, providing in reduced overall production process cycle times without compromising pressing quality.

In production settings where more than one press works in a same or related production process, such as a line of presses, the inventive hybrid mechanical press provides greater opportunity for optimization of a press line by coordinating the motion of all presses and feeders or transfer mechanisms/unloaders such as loading/unloading robots, in the process or press line.

For example, line coordination may be carried out by controlling such a line using a single controller, due to the improved controllability of the presses according to an embodiment of the invention. Coordination or optimisation may be achieved in part by adapting speed during opening/closing a press (while for example maintaining a required speed and energy output during the pressing/stamping part of the cycle), resulting in cycle times which may be reduced dependent on parameters such as: a state of a downstream process; or a state of an upstream process or another consideration such as overall power consumption; reduced energy consumption; smoothing power consumption peaks in the press line.

In a preferred embodiment of the method of the invention the method may be carried out by a computing device comprising one or more microprocessor units or computers. The control unit(s) comprises memory means for storing one or more computer programs for carrying out the improved methods for controlling the operation of a mechanical press. Preferably such computer program contains instructions for the processor to perform the method as mentioned above and described in more detail below. In another embodiment the computer program is provided on a computer readable data carrier such as a DVD, an optical or a magnetic data device.

BRIEF DESCRIPTION OF THE DRAWINGS

Embodiments of the invention will now be described, by way of example only, with particular reference to the accompanying drawings in which.

DETAILED DESCRIPTION OF THE EMBODIMENTS

Figure 1:
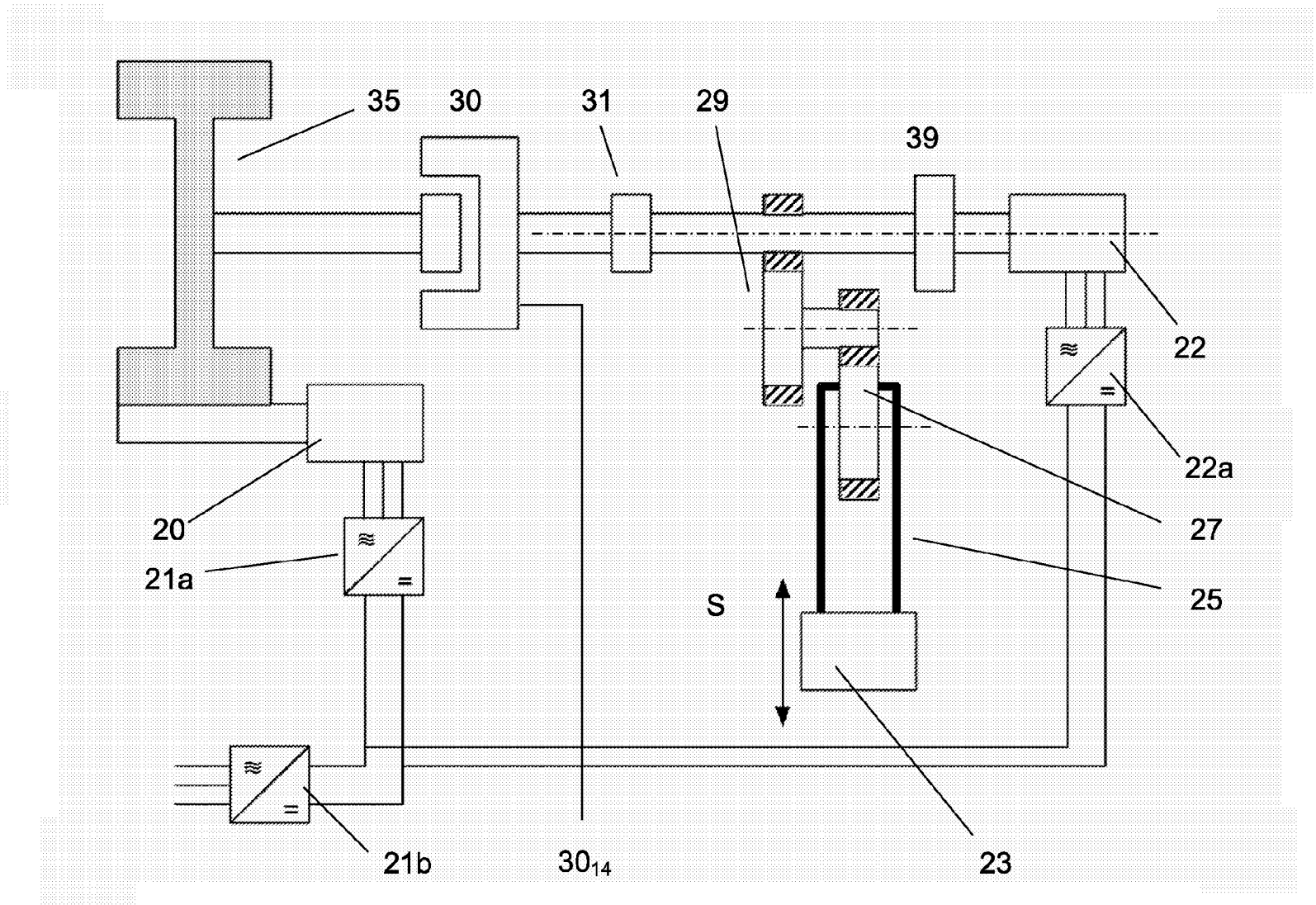
FIG. 1 is a schematic block diagram for an improved mechanical press according to an embodiment of the invention.
Figure 2:
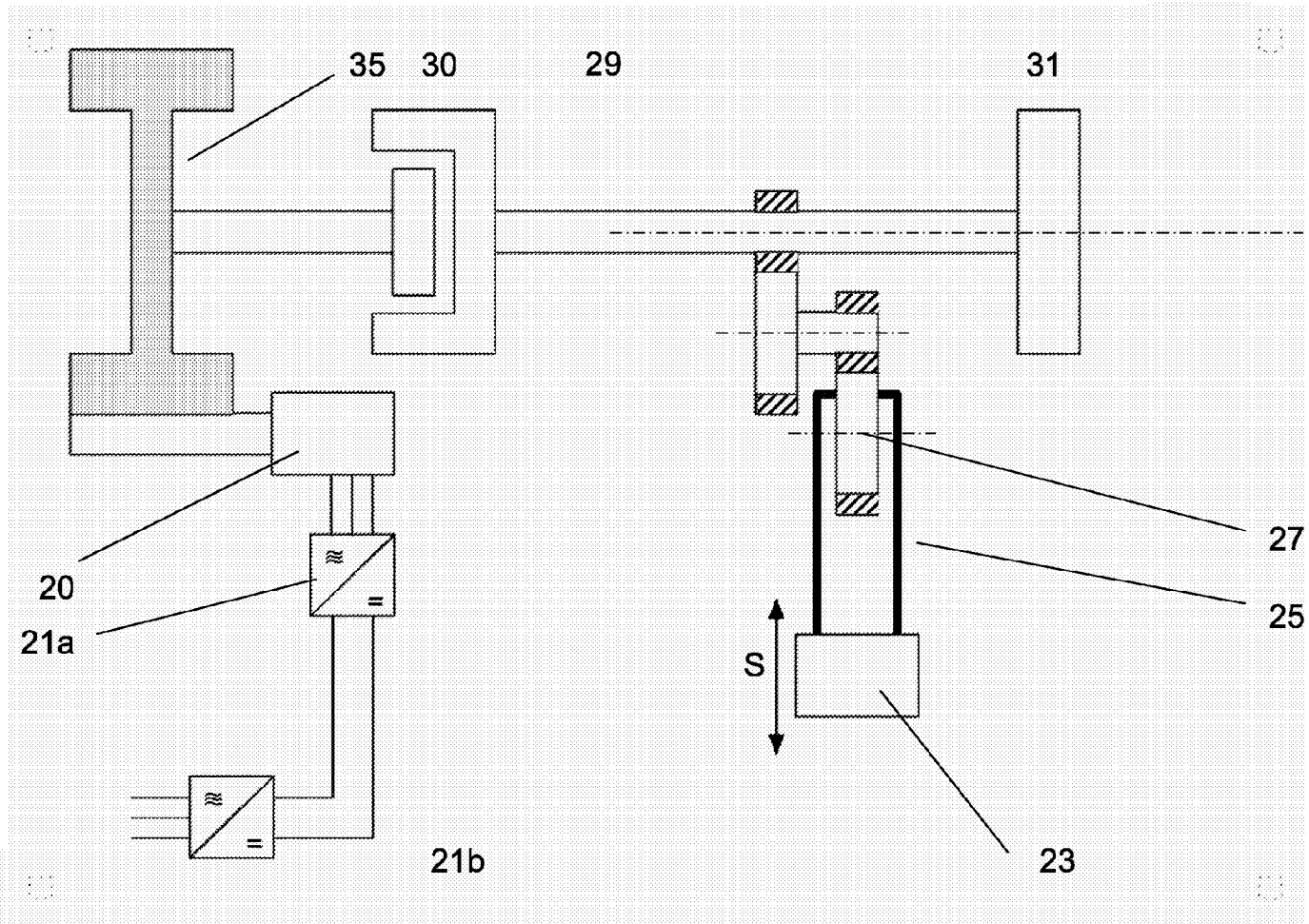
Fig 2 Prior Art
FIG. 2, Prior Art, is a schematic diagram is showing a known mechanical press of a flywheel type.

FIG. 1 shows a schematic layout for an improved mechanical press according to an embodiment of the invention. It shows a slide or press ram 23 which is driven in a up-and-down motion S by an eccentric drive wheel 27. The eccentric drive wheel is in turn driven by a press gear mechanism 29 each part of which is shown in a simplified cross section in which gear teeth are indicated by cross-hatching. Flywheel 35 is driven by a drive motor 20. During the pressing stage, the clutch 30 between flywheel 35 and press gear mechanism 29 is engaged (E). The numbering in FIG. 1 is essentially the same as the numbering in Prior Art FIG. 2 for the same components.

In FIG. 1 a second drive motor or actuator, such as electric motor 22, is arranged connected to the press gear mechanism 29. An optional second gearbox or other transmission means 39 is shown arranged between the second drive motor and the press gear 29. During the complete press cycle, the second motor is normally connected to the press gear mechanism 29 and driving the press all the time. The eccentric wheel is thus also driven through the press gear mechanism by second drive motor 22. First drive motor 20, which may or may not be a servo motor, is arranged with an inverter 21*a* and a rectifier 21*b* which are connected to a grid or power network (not shown). Second drive motor 22 is also arranged with an inverter 22*a* in the arrangement shown. Other motor control means may be substituted. Other power equipment arrangements may be substituted. The clutch is operated by means of a control unit $\mathbf{30}_{14}$. The Figure also shows an optional emergency brake 31. Either of the first and/or second drive motors may have an AC supply as shown or a DC supply. The motor speed control means may comprise a frequency converter, an inverter/rectifier as shown or other motor speed control means. Motor speed control means may also be shared with other presses or machines.

Figures 3, 4:
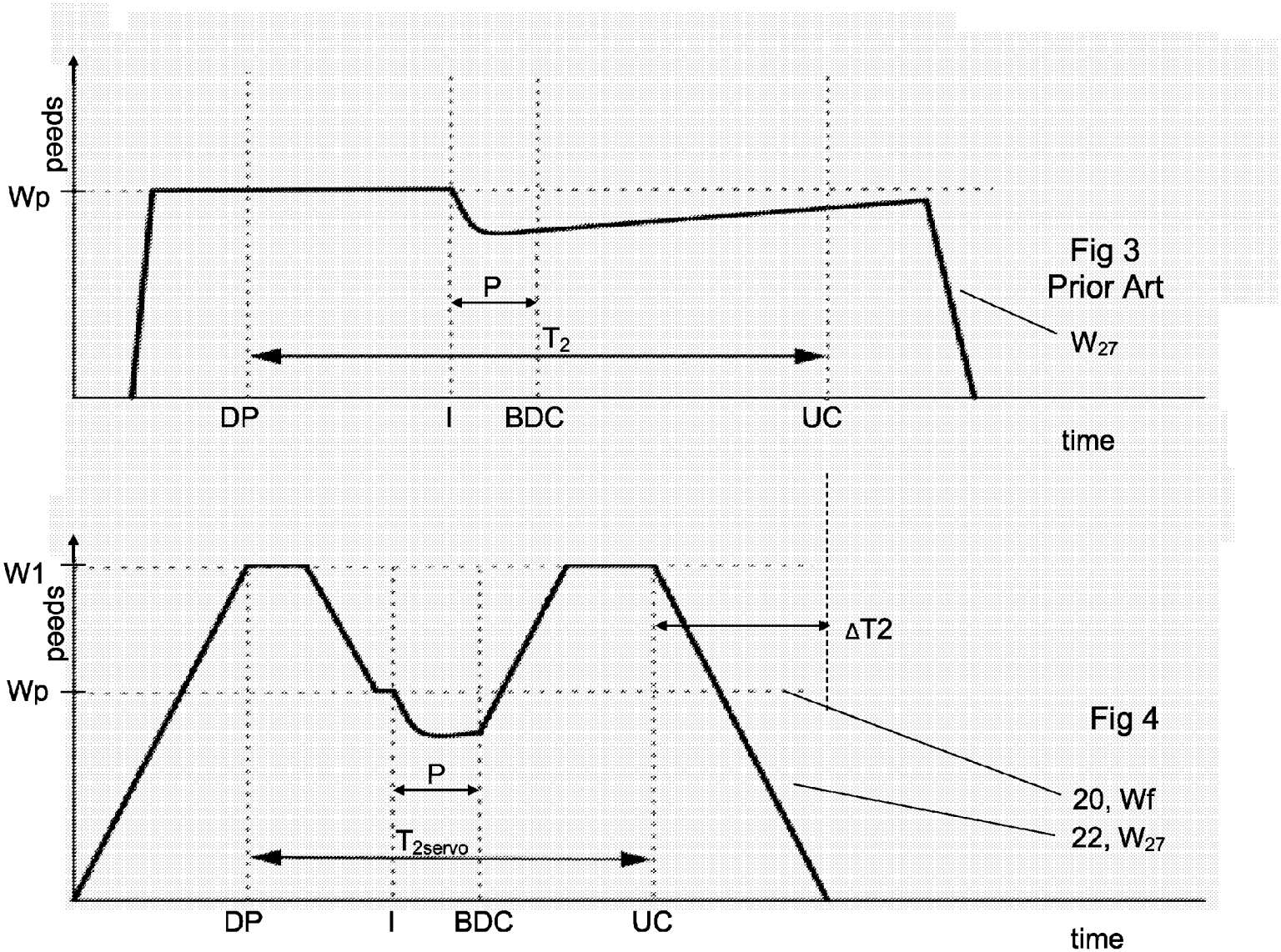
Fig 3 Prior Art
FIG. 3 Prior Art is a schematic diagram showing a speed-time profile according to a press cycle for a known mechanical press.
FIG. 4 is a schematic diagram showing a speed-time profile for a press cycle of an improved press according to an embodiment of the invention.

FIG. 3 Prior Art is discussed briefly above in the background section. It shows a speed profile for a traditional mechanical press. The figure shows target pressing speed Wp and actual speed of the eccentric 27 is indicated as $W_{27}$.

FIG. 4 shows a schematic diagram for a press cycle according to an improved method for operating a mechanical press according to an embodiment of the invention. The diagram shows a press cycle in terms of eccentric speed over time. It shows a cycle start at zero speed (left of diagram) and a first pre-pressing stage of accelerating the press by means of the second motor to a high or maximum press speed of W1. In a second pre-pressing stage, maximum speed is maintained for a period of time before the press in a third pre-pressing stage is decelerated by the second motor to a selected pressing speed Wp. During the next stage, the pressing stage P, the motor speed is normally slowed somewhat while work is performed by the press tool in deforming the blank or workpiece by pressing, stamping, punching etc. The pressing stage begins at a point of first impact I between die and workpiece and continues till Bottom Dead Centre (BDC) or thereabouts. Directly following the pressing stage the press is accelerated again in a fourth non-pressing stage to a high or maximum speed W1 or similar by the second motor. In a further fifth non-pressing stage, the second motor is maintained at high or maximum speed. In a further sixth non-pressing stage, the speed is reduced to zero in time to end the press production cycle. For a press cycle that exceeds 360 degrees, the press may be reversed at the end of each press cycle and driven backwards to the start position before starting the next press cycle.

In a traditional speed profile for a mechanical press of the prior art, as shown in FIG. 3, the maximum press speed during a press cycle is fixed for a traditional flywheel press to the pressing speed Wp. The improved mechanical press according to one aspect of the invention equipped with a second motor or actuator may be accelerated to a higher speed than the pressing speed during the non-pressing stages of the production cycle. Thus the production cycle time may be shortened.

FIG. 4 also shows other aspects of the improved press production cycle, and indicates positions of the press which are concerned with loading a blank or workpiece into the press and subsequently removing the workpiece after the pressing (stamping, punching etc) stage. At the start of the press production cycle the press is open and a blank may be loaded. As the press begins to close in the pre-pressing stage there comes a point after which the press has closed to an extent that there is no longer sufficient clearance to load in a workpiece without damaging the press die or the loader. This point, as measured in terms of crank angle, is called the die protection angle, DP. (The point may otherwise be referenced in other terms such as of position in the press stroke, the linear distance from TDC or BDC between the ram and the die etc.)

Correspondingly, there is a point in a non-pressing stage following the pressing stage after which the press has opened sufficiently that the workpiece may be removed without damage to the workpiece or the die. This point, as measured in terms of crank angle, is called the Unload Cam angle. Unload cam angle (UC) is used here to mean the limiting point or time when the die is opening and has opened sufficiently to withdraw and unload the blank after forming. Both the die protection angle and the unload cam angle may vary to some extent between production of different articles, typically dependent both on the blank used and on the depth to which the blank is drawn down over a die.

Thus in FIG. 4, the stages of the press production cycle shown comprises pre-pressing stages, a pressing stage, and post pressing stages. The cycle may be described thus:

- a first non-pressing stage, accelerate second motor 22 as fast as possible (normal for shortest cycle time) until press reaches W1;
- a second non-pressing stage hold second motor at maximum press speed of W1;
- third non-pressing stage reduce second motor speed to Wp as late as possible;
- a pressing stage, clutch engaged (E FIG. 5) with target speed for pressing of eg Wp for both first and second motors,
- fourth non-pressing stage disengage clutch (D FIG. 5), accelerate second motor as fast as possible (normally) until W1, and set first motor target speed to Wp (usually);
- fifth non-pressing stage hold second motor at high speed eg W1;
- sixth non-pressing stage reduce second motor speed to zero,
- optionally for alternative bi-directional pressing to drive second motor at end of press cycle to reverse press backwards in second rotation direction to the cycle start position.

The improved pressing cycle provided by the control method for controlling the improved press allows the total production cycle to be shorter than the production cycle of a traditional mechanical press of the prior art by shortening the time taken to carry out the non-pressing parts of the cycle. In particular, the time period from the latest loading point DP point to the earliest unloading point UC, denoted as T2, may be shortened by means of running the press at increased speeds W1 greater than the pressing speed Wp then reducing to Wp or, at the cycle end, to zero. This is indicated schematically on the diagram by the difference in time for T2, ΔT2 in FIG. 4. Although the improved press cycle is mainly described in terms of a cycle or of separate cycles is may be applied to both Single Stroke operation and/or Continuous operation. During Continuous operation the press is operated without stopping the press between successive press cycles. Depending on the time needed for loading and unloading, the press may instead be slowed down and not stopped.

Figure 5:
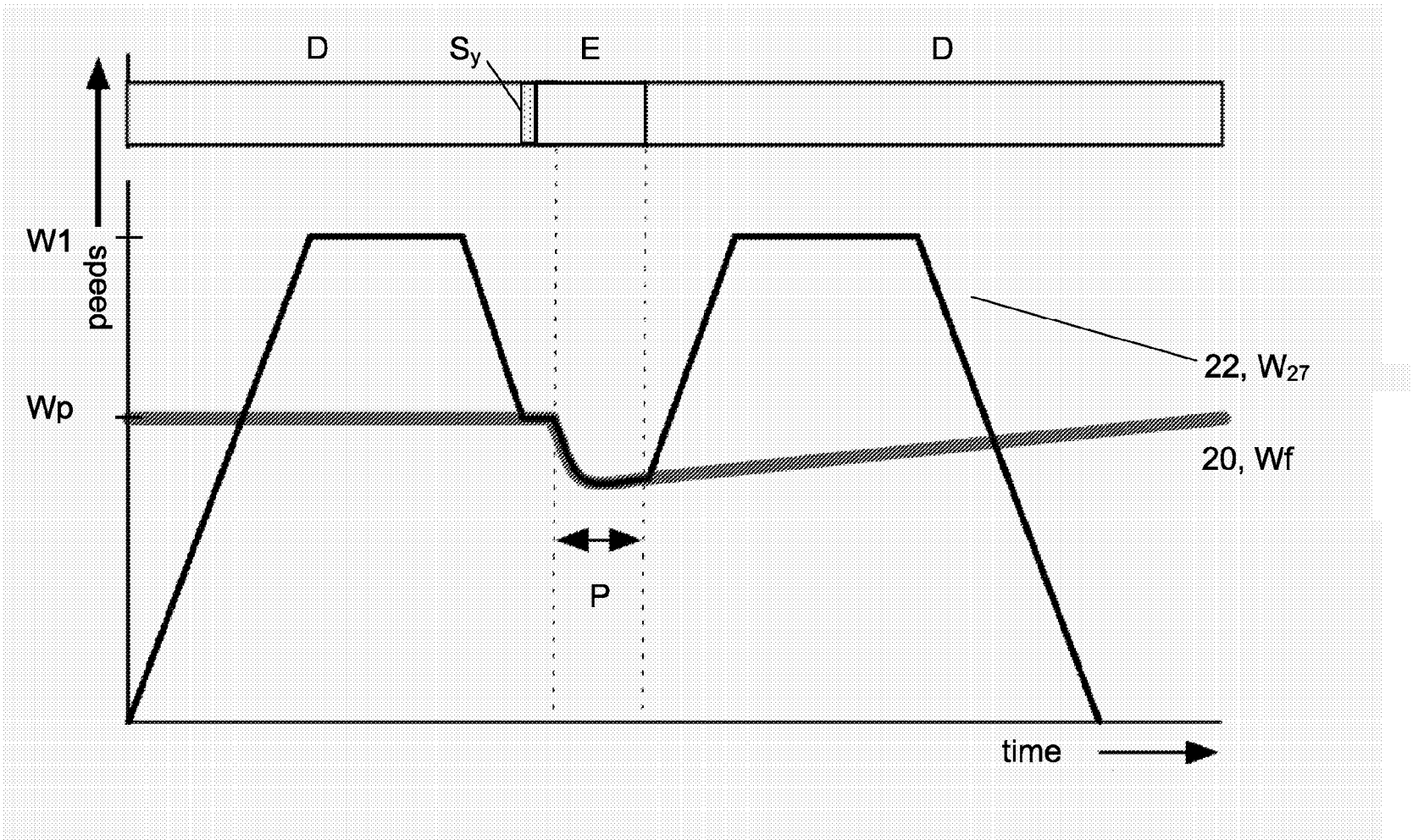
FIG. 5 is a schematic speed-time profile showing scaled down motor speed and flywheel speed against time according to a press cycle of an improved press according to an embodiment of the invention.

FIG. 5 shows a speed profile for an improved press with a flywheel and with a second drive motor arranged for example as shown in FIG. 1. It shows an eccentric speed and scaled down flywheel speed Wf against time for the same time period. During a first time period the press slide is accelerated by the second motor 22 to a speed W1 which is greater than the normal pressing speed Wp. The press speed is reduced by second motor 22 to Wp in time to begin the pressing cycle. During this time clutch 30 of FIG. 1 connecting flywheel 35 to the press gear mechanism and slide has been dis-engaged, D.

At the beginning of the pressing stage P, or just before, clutch 30 is engaged so that the flywheel is driving the press and the pressing operation takes place. During the pressing stage the flywheel and press speed normally drop below the initial pressing speed Wp. In the third period of time after the pressing stage the flywheel is again disconnected from the press drive and the flywheel speed increased by the drive motor 20 back up to Wp. At the same time, the press is accelerated by the second drive motor up to a high or maximum speed such as W1, maintained at high speed, and then the speed is reduced to zero in time for the end of the cycle. At the end of the cycle the press and slide are at a standstill and the flywheel is rotating at pressing speed Wp. Alternatively, the flywheel may be accelerated back to Wp later depending on the selected control method and/or strategy for energy saving or peak power use.

Figure 8:
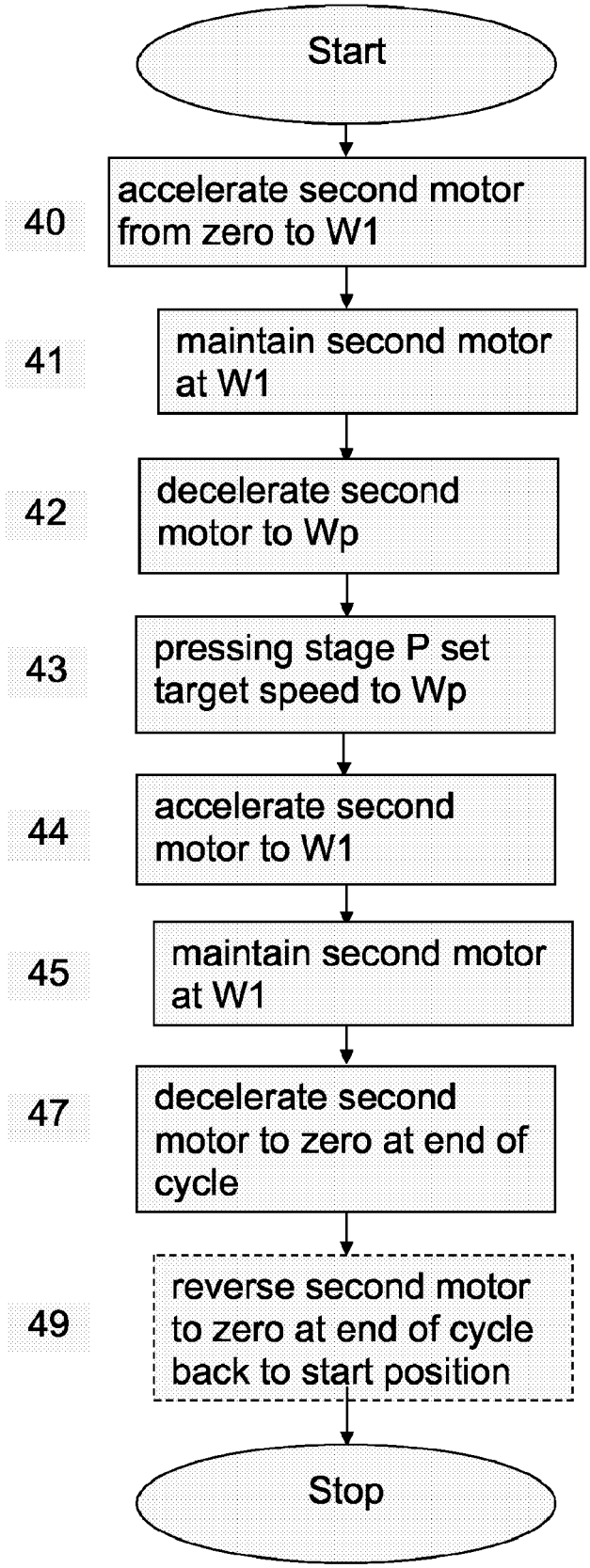
FIGS. 8-10 are a schematic flowcharts for methods to operate an improved mechanical press according to two or more embodiments of the invention.

FIG. 8 is a flowchart for a method to operate the improved mechanical press according to an embodiment of the invention. The method comprises a pressing stage: and the steps described here do not refer to the engagement or disengagement of clutch to flywheel but focus on control of the second drive motor 22;

40 accelerate second drive motor from zero to W1
41 maintain second drive motor at W1
42 decelerate second drive motor to Wp
43 pressing stage P set target speed to Wp
44 accelerate second drive motor to W1 after pressing stage P
45 maintain second drive motor at W1
47 decelerate second drive motor to zero at end of cycle. and optionally:
49 reverse second drive motor at end of press cycle and drive to start position for next press cycle.

Figure 9:
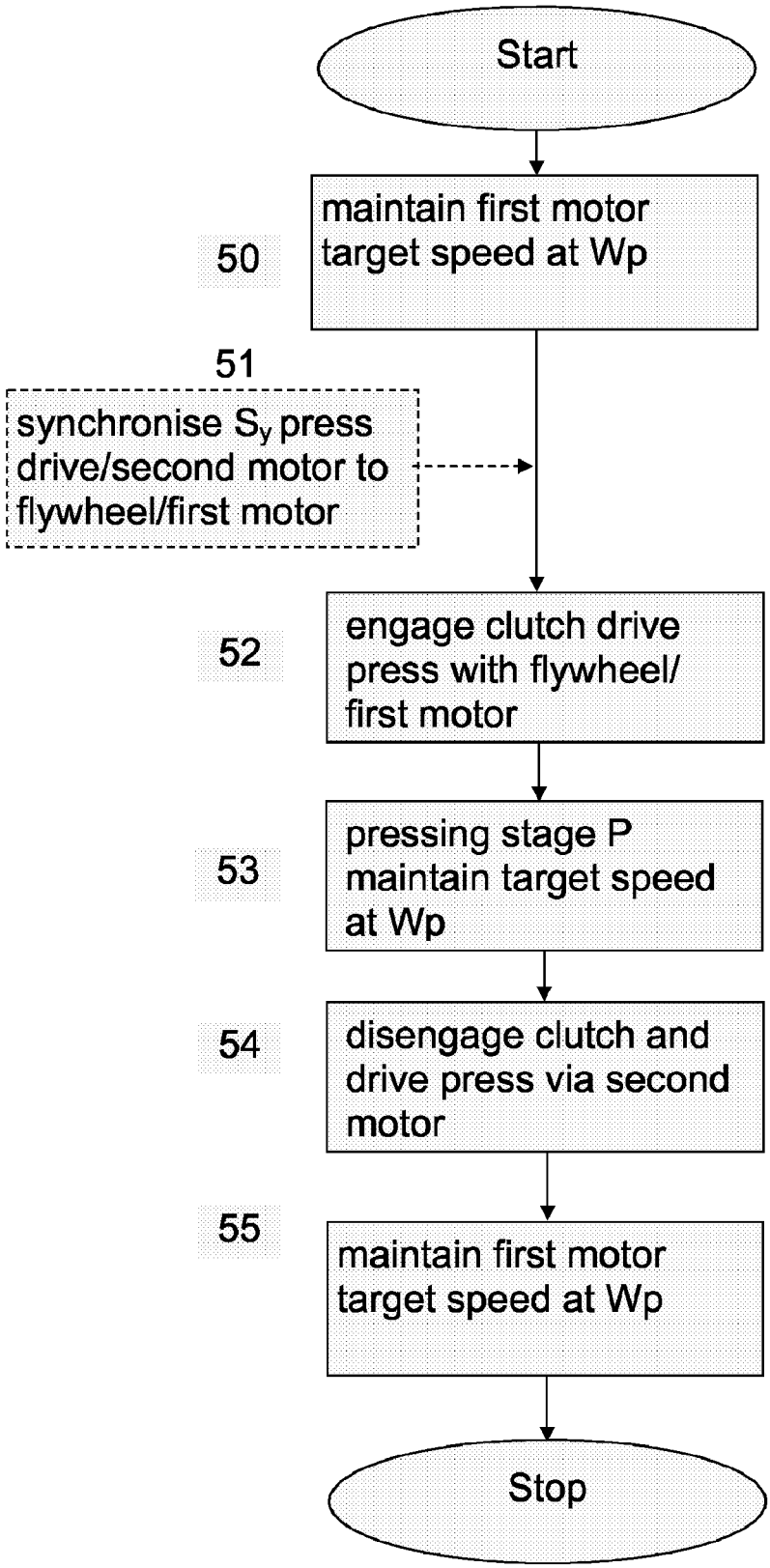

FIG. 9 is a flowchart for a method to operate the improved mechanical press according to an embodiment of the invention, and the method focuses on control of the first motor 20 driving the flywheel;

50 maintain first motor target speed at Wp
51 synchronise $S_y$ press drive/second motor speed to same as flywheel/first motor speed
52 engage (E) clutch and drive press with flywheel and first motor
53 pressing stage P maintain target speed at Wp
54 disengage (D) clutch and drive press with second motor
55 maintain first motor target speed at Wp Alternatively in step 51 it may be that the speed of the second motor is synchronised with the speed of the first motor.

Figure 10:
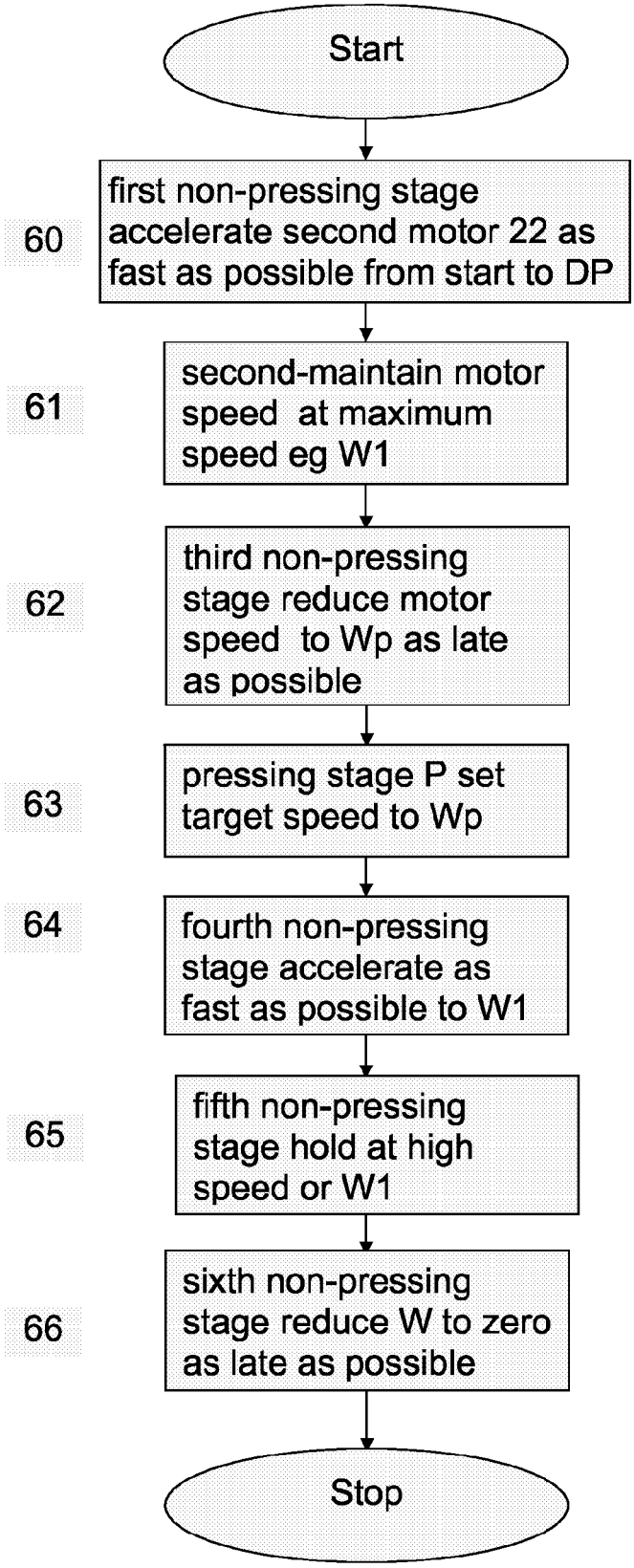

FIG. 10 is a flowchart for a method to operate the improved mechanical press according to a further embodiment of the invention. The method comprises a pressing stage and a plurality of non pressing stages. The method may further be described as comprising pre-pressing stages, a pressing stage, and post pressing stages. The description of this method is focused on control for second drive motor 22. As may be seen above in the description in reference to FIG. 4 the method begins with:

60 accelerate as fast as possible from start up to DP
61 maintain motor speed at maximum press speed of W1
62 reduce motor speed to pressing speed Wp as late as possible
63 set target speed such as Wp for pressing stage P
64 fourth non-pressing stage accelerate as fast as possible to W1
65 fifth non-pressing stage maintain motor speed at a maximum press speed such as W1 as long as possible,

66 sixth non-pressing stage reduce to zero, usually as late as possible to shorten cycle time, depending on control strategy and cycle time optimisation versus energy saving/peak power optimisation.

This method comprises steps to control the improved press so as to achieve a total press production cycle which takes as little time as possible. Other constraints may be included or conditionally included in the above method as applied to a stand-alone press, for example to coordinate with loading/unloading requirements for the press or to optimise peak power and/or energy consumption for this press. This peak power and/or energy consumption may for example be optimised with regard to acceleration and regenerative braking during speed reduction periods.

Control constraints may comprise production cycle time and/or energy saving requirements and/or reducing peak power use. However to give examples of control methods:

1) to obtain shortest possible press cycle:

Both motors are used up to their respective torque and power limits to obtain the shortest possible cycle. Peak power into the system will equal the combined peak power of the two motors.

flywheel motor (first drive motor 20) operates with speed control to maintain flywheel at pressing speed, at all times. Power or torque limited only by limit of this motor and its associated converter.

the second or auxiliary motor accelerates the press from standstill at start position to maximum speed as fast as possible. Power or torque limited only by limit of this motor and its associated converter.

auxiliary or second drive motor maintains the press at a constant speed.

as late as possible, auxiliary motor reduces press speed, so that desired pressing speed is reached shortly before impact.

the clutch is engaged, while the auxiliary motor is controlled in one of the following ways:

no control: clutch is engaged when press speed and flywheel speed are almost equal.

speed control: auxiliary motor controls press speed to equal flywheel speed just before and while engaging the clutch.

speed and position control: auxiliary motor controls position and speed of the press so that a precise relation between shaft positions on both sides of the clutch is obtained, just before and while clutching.

after engaging the clutch a common speed control for the two motors is used to avoid oscillations. While pressing, press force will typically be much larger than the force the two motors together can provide, so both motors will operate in either power or torque-controlled or torque limited mode.

at around bottom dead center (or possibly before depending on the type of pressing operation, stamping or hot stamping or punching), the clutch is disengaged.

after the clutch is fully disengaged, the auxiliary motor accelerates the press to maximum speed as fast as possible. Power or torque limited only by limit of this motor and its associated converter.

auxiliary motor maintains constant speed until a decelerating position, when the auxiliary motor starts decelerating the press as fast as possible.

typically, the press will reach zero speed at a position after passing the start position. Maximum torque of the motor will now be used to reaccelerate the press in reverse direction.

at a point between zero-speed position and start position, the torque of the auxiliary motor is reversed. The auxiliary motor now uses its maximum torque to slow down the press, to a standstill at start position.

some final position control may be needed to ensure that the press stops exactly at the desired position.

the auxiliary motor is then switched off (or maintains press position) until the start of the next press cycle.

2) to obtain shortest possible press cycle while limiting peak power

The power of the flywheel motor is reduced so that the total peak power does not exceed the peak power of the auxiliary motor.

3)

Electrical power consumption of the drive motor of a press may be improved or smoothed by use of regenerative braking. The second motor in particular may be decelerated to a reduced speed or to a zero speed by means in part of regenerative braking. For example a speed reduction during the first pre-pressing stage from W1 to Wp, and a speed reduction after pressing from W1 to zero. A system comprising an improved press according an embodiment of the invention may comprise energy recovery means for recovering energy from the second motor during deceleration or braking. This may be any recovery means such as for example electrical, mechanical or chemical. This may involve use of one or more capacitors, batteries, mechanical device such as flywheels, mechanical springs or devices comprising a reservoir of a compressible fluid. For example energy recovered from the second motor may be stored in the flywheel driven by the first drive motor. The stored energy is principally reused during one or more of the following periods of the press cycle: initial acceleration at start of the press cycle; pressing; reacceleration after pressing; reacceleration of the flywheel after pressing.

As an alternative method of operating the improved mechanical press according to another embodiment of the invention, the press may also be run without the flywheel being connected at all. This is normally only an option when the second motor, or second motor and inertia together, are sufficiently powerful to press or form the current workpiece. This is advantageous to overcome temporary delays or other production problems which may be due to a fault with the first motor, flywheel or clutch mechanisms. It also simplifies motor control during hot stamping of some parts in which the press stands still at around BDC for a period of time.

According to another embodiment of the invention, the drive motor of the press is controlled to operate the press in an improved press cycle which extends over greater than 360 degrees crank angle or equivalent when expressed in terms of a press opening distance. Whereas a conventional mechanical press has a press cycle of 360 deg and typically begins and ends at Top Dead Centre (TDC).

Figures 7, 7A, 7B, 7C, 7D:
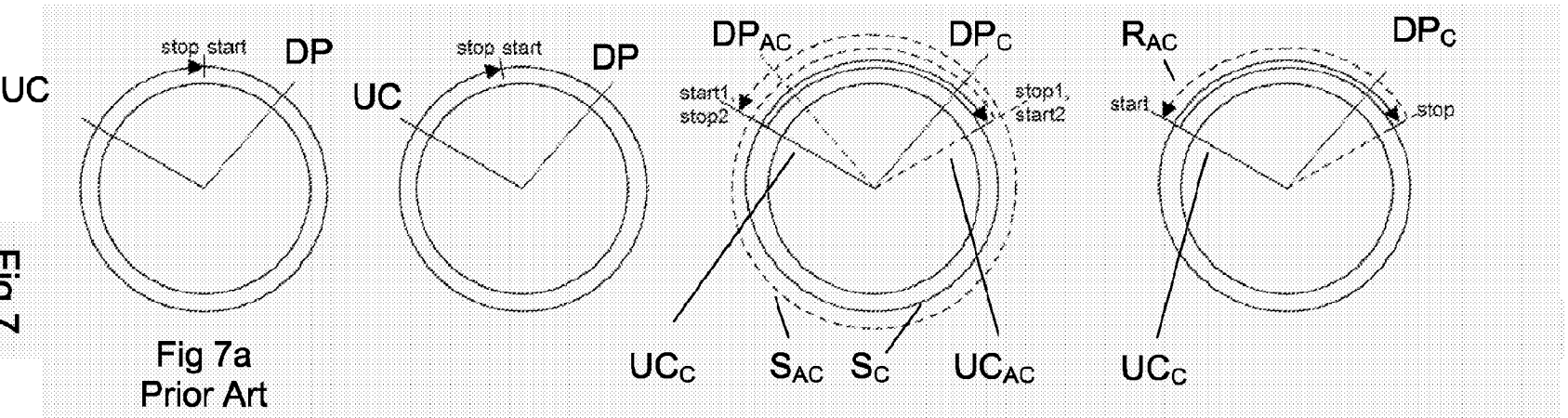
Fig 7a Prior Art
FIG. 7*a*, Prior Art, shows a standard 360 degree press cycle according to a known press cycle.
FIGS. 7*b*-7*d* shows in schematic diagrams press cycles in relation to start/stop position and rotation direction according to operating methods for embodiments of the invention.

FIG. 7*a* shows a standard press cycle of the Prior Art. It shows a 360 degree cycle in one rotational direction. The cycle starts and stops at 0/360 degrees. Relative positions for DP and UC are schematically indicated.

According to another embodiment of the present invention an improvement is provided to methods for operating a mechanical press comprising an electric drive motor wherein the press is moved backwards between successive press production cycles operations instead of changing rotation direction of press operation for every alternate cycle.

Figure 6A:
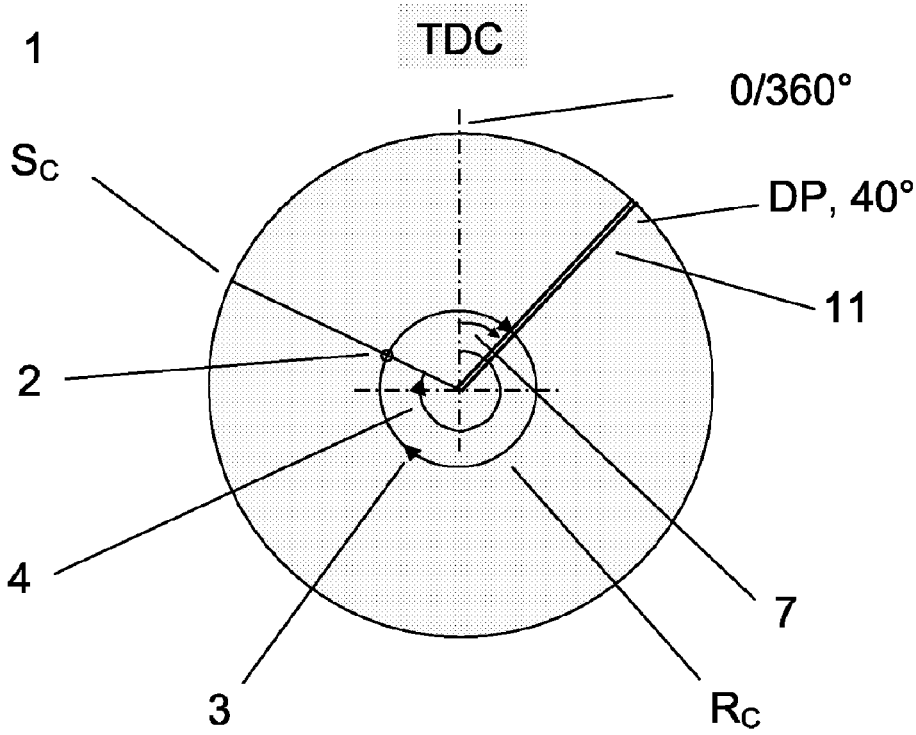
FIG. 6*a* is a schematic diagram showing a press cycle in relation to degree and rotation direction according an embodiment of the invention and FIG. 6*b* is a diagram showing a second rotational direction according to another and bi-directional embodiment of the invention.

FIG. 6*a* shows a press cycle 1 comprising a cycle $S_C$ in a first clockwise direction, see arrow 3. The press cycle $S_C$ begins with a start point 2 for, in this example, a clockwise rotation from a point 2, which is an angle 4 of about 300 degrees. The first cycle traverses clockwise $R_C$ through about 460 degrees to a cycle stop 11 with an angle 7 (DP 40) of approximately 40 degrees. At the end 11 of the first cycle the press motor is then rotated in a reverse direction $R_{AC}$ (check) back to the same start point $S_C$ as the previous pressing cycle.

The control and acceleration and/or deceleration of the improved press cycle may be varied. A press cycle may for example start at 300 degrees, accelerate clockwise through 100 degrees to 40 degrees and rotate through a forming phase. After forming deceleration begins at 300 degrees and may run through 100 degrees to a standstill occurring at 40 degrees. Then, in a time period during which for example, machines are unloading/loading the press, the press is moved backwards $R_{AC}$ from 40 degrees to 300 degrees, so that the next operation is then ready to be started again from 300 degrees, and once again in a clockwise or forward direction. This method is most effective when sufficient time is available for the backward motion during a dead time such as unloading/loading.

Figure 6B:
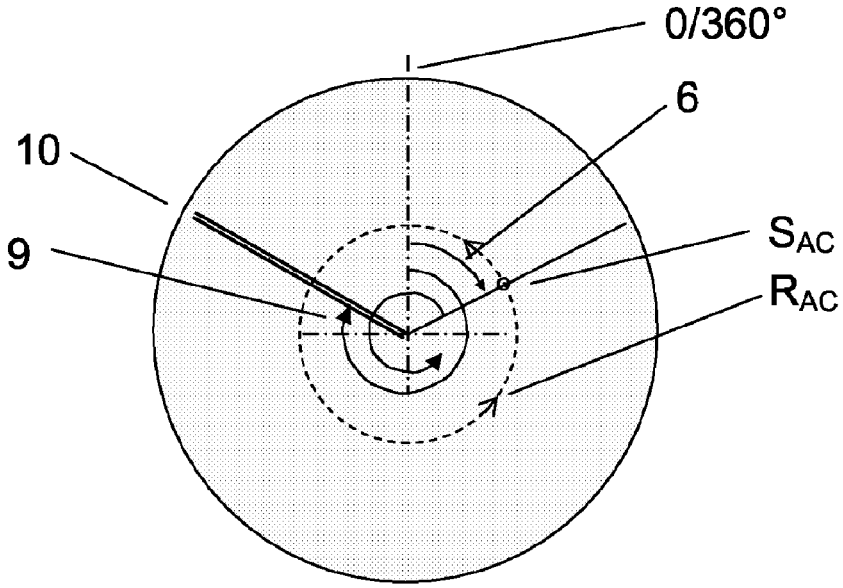
Figure 6C:
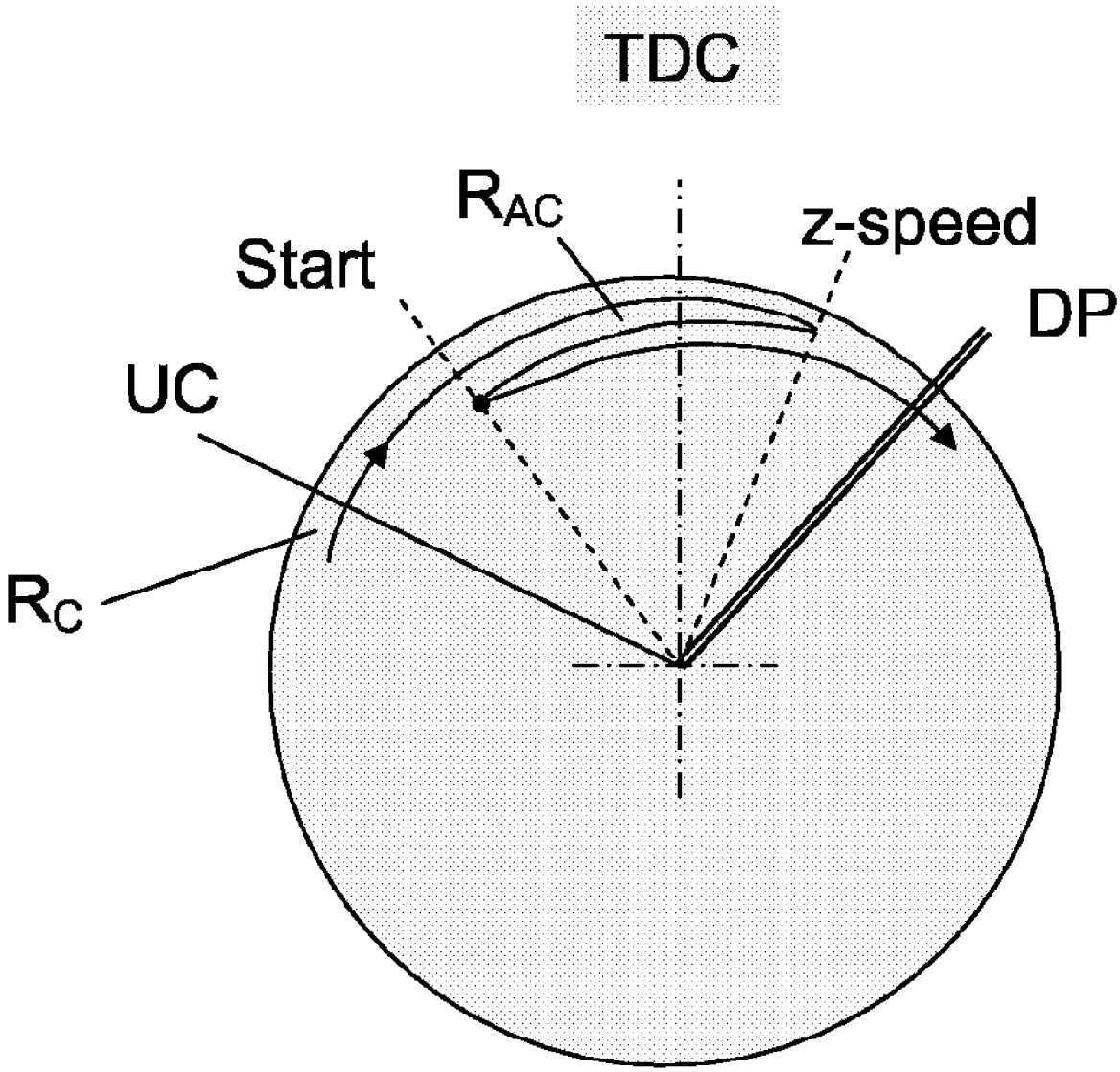
FIG. 6*c* shows an alternative view of the bi-directional embodiment of 6*b;*

FIG. 6*c* shows this movement in another diagram for the sake of clarity. FIG. 6*c* shows the last stages of a clockwise cycle. The press moves past the Unload Cam position (UC) and is decelerating. At a point after UC the press decelerates to a zero speed at z-speed. The press reverses in the anticlockwise direction $R_{AC}$ to the start position of the next cycle, at "start", for another clockwise cycle $R_C$. The zero-speed position will typically be after TDC, but may also be arranged instead at or before TDC. The press cycle will always be more than 360 degrees in this embodiment.

FIG. 7*d* shows an alternative embodiment in which the press rotates in a first rotational direction through a press cycle greater than 360 degrees. At the end of the cycle the press then reverses to the start position. FIG. 7*d* shows a Start at about 10 o'clock which runs clockwise, solid line, to $DP_C$ at about 1 o'clock, clockwise round to $UC_C$ at about 10 o'clock, continuing to finish at Stop at about 2 o'clock. The press then reverses $R_{AC}$ in an anticlockwise direction to the start position at around 10 o'clock.

One or more microprocessors (or processors or computers) comprise a central processing unit CPU performing the steps of the methods according to one or more aspects of the invention, as described for example with reference to FIG. 9. The method or methods are performed with the aid of one or more computer programs, which are stored at least in part in memory accessible by the one or more processors. It is to be understood that the computer programs for carrying out methods according to the invention may also be run on one or more general purpose industrial microprocessors or computers instead of one or more specially adapted computers or processors.

The computer program comprises computer program code elements or software code portions that make the computer or processor perform the methods using equations, algorithms, data, stored values, calculations and the like for the methods previously described, for example in relation to FIGS. 8-10 and in relation to the speed profile of FIG. 4, 5 and to the methods described in relation to FIGS. 7*b-d*. The computer program may include one or more small executable program such as a Flash (Trade mark) program. A part of the program may be stored in a processor as above, but also in a ROM, RAM, PROM, EPROM or EEPROM chip or similar memory means. The or some of the programs in part or in whole may also be stored locally (or centrally) on, or in, other suitable computer readable medium such as a magnetic disk, CD-ROM or DVD disk, hard disk, magneto-optical memory storage means, in volatile memory, in flash memory, as firmware, or stored on a data server. Other known and suitable media, including removable memory media such as Sony Memory Stick™ and other removable flash memories, hard drives etc. may also be used. The program may also in part be supplied from a data network, including a public network such as the Internet. The computer programs described may also be arranged in part as a distributed application capable of running on several different computers or computer systems at more or less the same time.

FIG. 7*b* shows an embodiment in which a cycle may begin and/or end at a position not equal to 0/360.

The embodiment of FIG. 7*c* requires additional clutch or transmission means in order to operate fully in a reverse direction, because the flywheel typically rotates in one direction only from one cycle to the next. FIG. 7*c* shows an embodiment in which a modified press with a second drive motor or actuator operates bi-directionally. A clockwise cycle $S_C$, solid line, begins at Start 1 about 10 o'clock and continues clockwise to $DP_C$ at about 2 o'clock, round till $UC_C$ at about 10 o'clock and finishes at Stop 1 shortly after $UC_C$ at about 1 o'clock. Similarly the press then rotates in a reverse direction, dashed line, beginning at Start 2 of about 2 o'clock and continuing anticlockwise to $UC_{AC}$ at about 11 o'clock, continues round to $DP_{AC}$ at about 2 o'clock and finishes Stop 2 at about 10 o'clock.

FIG. 6*b* also shows the cycle in a second rotational direction, cycle $S_{AC}$ shown with a dashed line which starts at an angle 6 of about 60 degrees and continues anticlockwise $R_{AC}$ around over 360 degrees to a stop 10 at an angle 9 which may be about 300 degrees. The improved press cycle of the present embodiment extends over more than 360 degrees, and the rotational direction is changed on every operation. This is in contrast to the traditional methods with starting and stopping at the same position during every operation, typically at TDC, as is done with traditional mechanical presses.

The improved press cycle of the present embodiment of FIGS. 7*b* and 7*d* may extend over more than 360 degrees. Using the above improved methods the press system may be controlled so that the motor accelerates the press ram during as much as up to 100 degrees or so (and decelerates during as much as up 120), which are greater extents compared to 50 degrees of acceleration in a typical traditional mechanical press or servo press and/or 40 degrees acceleration using a traditional start/stop position. The torque required to reach a predetermined speed such as W1 for the improved press cycle may be reduced by a factor two—or even more, taking into consideration that reducing the motor size reduces the total system inertia as well.

Figure 11:
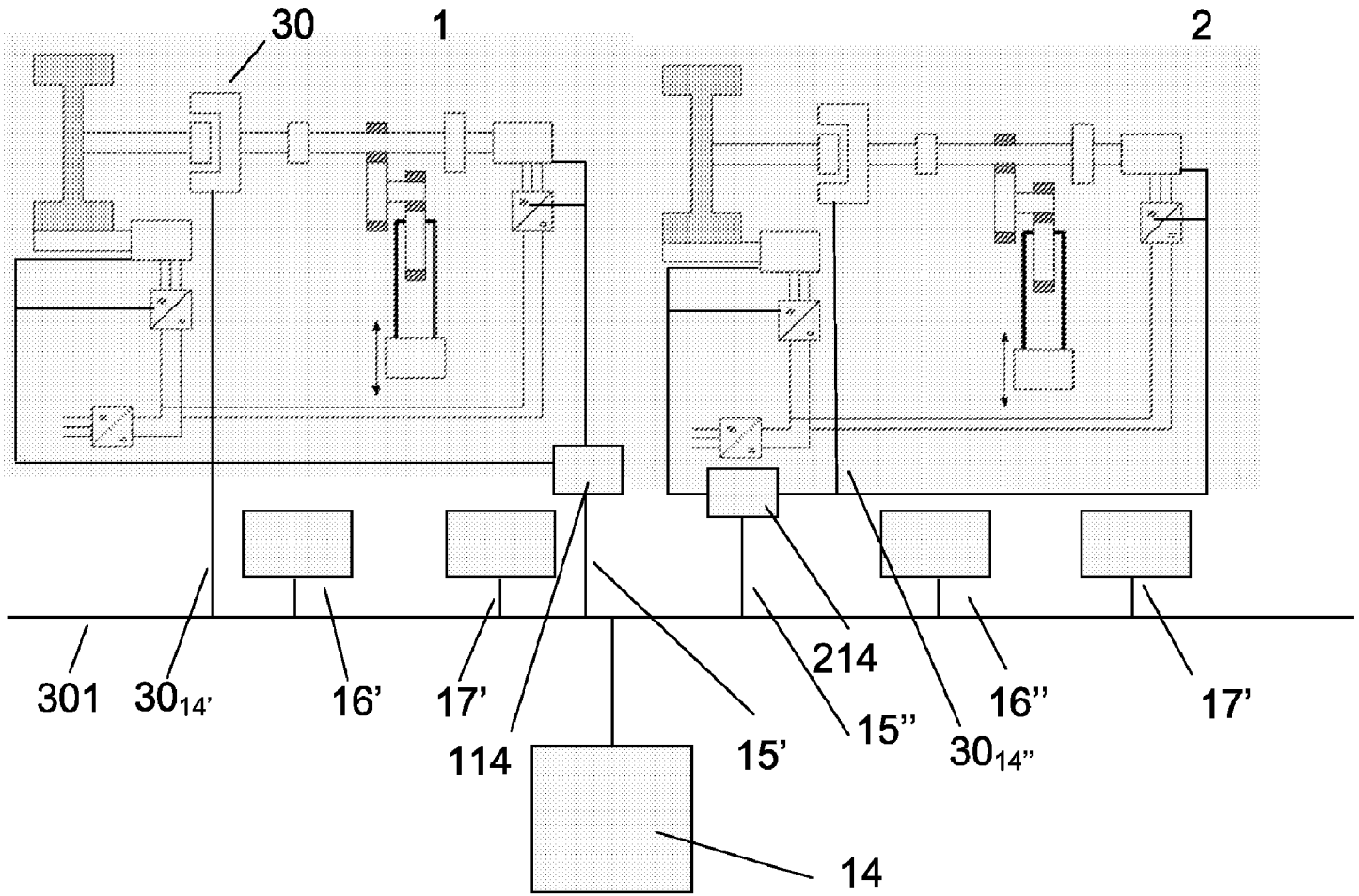
FIG. 11 is schematic diagram for a system comprising one or more improved presses according to an embodiment of the invention.

A production system may include one or more improved presses according to one or more embodiments of the invention. For example one or more presses may be included in a press line, where a plurality of presses operate on the same or related components. FIG. 11 shows a schematic layout for a system comprising two presses. The figure shows a first 1 and second press 2 both of the hybrid type comprising a second motor or actuator. The figure also shows loader/unloader 16', 17' and 16", 17" associated with each press 1, 2. In practice a loader of one press may also be the unloader of another press (or vice-versa). Press 1 may have a control unit 114 to which the converter of each or both drive motors are connected. A position/speed sensor for each drive motor may also be connected to press control unit 114. A control unit 14 is shown connected to a data network 301 which may be a fieldbus or any other type of data network. Clutch control may be carried out for example via a connection $\mathbf{30}_{14'}$ to a fieldbus or a connection $\mathbf{30}_{14''}$ to a press control unit 214". Presses 1 and 2, and loading/transfer/unloading devices 16, 17 are preferably all connected 15 in some way to a control unit 14, either directly or via a control unit for a press such as 114 or 214. Thus operations of either or both presses and of the loaders/unloaders may be coordinated. Control unit 14 may even be a control unit that also controls the functions of one or more loaders/unloaders, such as robots associated with press 1 and/or press 2. Certain robot control units may handle up to 9 axes of movement, so that press control may be handled as an extra axis or axes of a robot.

In the production system context optimisation and coordination methods described above to optimise for a single stand-alone press may be extended over the group of processes. Thus recovered energy may be consumed by other machines and not just a stand-alone improved press. Power use over more than one machine may be optimised or coordinated, for example between press 1 and press 2, to reduce total peak power consumption or to reduce potentially disruptive peaking or spiking in power use. Such considerations for overall power use by a press line may also introduce constraints for acceleration, deceleration times etc that may be factored into method such as that described in reference to FIG. 6.

For example, to obtain the shortest possible cycle time the press is accelerated such as in step 60 of FIG. 9 as fast as possible but the acceleration may be varied to less than maximum to avoid an instantaneous power peak for the press line as a whole. The first acceleration to DP, step 60, may not be linear, and may be arranged to match a time period, the amount of time need by a loader to insert the workpiece, and thus take at least a given time to reach the DP angle, rather than a maximum and/or straight line acceleration. Similarly, the regenerative braking that is normally carried out, such as in connection for example with steps 62, 66 of FIG. 10, may be arranged with constraints to provide return energy to any of the same press, another machine, the press line or the grid.

It should be noted that while the above describes exemplifying embodiments of the invention, there are several variations and modifications which may be made to the disclosed solution without departing from the scope of the present invention as defined in the appended claims.

REFERENCES

1. High-tech presses, Servo technology meets mechanical presses by Dennis Boerger, Stamping Journal Nov. 2003, thefabricator.com

The invention claimed is:

1. A method for operating a mechanical press comprising a first electric drive motor, a drive control for controlling the first motor, a ram, a flywheel driven by the first motor, a clutch configured to connect the flywheel to the ram, a second drive motor or actuator arranged to drive said ram, and a translating member for translating rotational motion of said flywheel in a first rotation direction into a linear motion of said ram, wherein said ram is arranged to be lowered and raised along a linear path for operating said press to carry out a press production cycle, wherein said press production cycle comprises a pressing part and one or more non-pressing parts, the method comprising:

controlling output of the press through controlling said second drive motor such that the speed of said second drive motor is varied during at least one part of said press production cycle, wherein the second motor drives the press in a first rotational direction to a speed above a pressing speed prior to carrying out the press production cycle and slows the speed of the press down to a pressing speed at a pressing time;

carrying out the pressing with power at least from the flywheel; and reversing said second drive motor at the end of each complete press production cycle and driving the press in a second rotational direction with the second drive motor.

2. The method according to claim 1, wherein each complete press cycle carried out in said first rotation direction extends over more than 360 degrees of crank angle rotation.

3. The method according to claim 1, wherein said second drive motor is accelerated from a start up position in the first rotation direction not equal to Top Dead Centre or 0/360 degrees.

4. The method according to claim 1, wherein said second drive motor is accelerated by said drive control to a speed in excess of the pressing speed.

5. The method according to claim 1, wherein said second drive motor is accelerated by said drive control during a first part of the press cycle and beyond a die protect angle between the die and the workpiece.

6. The method according to claim 1, wherein the speed of said second motor is reduced from a first speed to a pressing speed before the position of first impact between the die and the workpiece.

7. The method according to claim 1, wherein said second motor speed is variable and may be synchronized with the rotational speed of said flywheel before engaging the clutch or other coupling member before the pressing stage.

8. The method according to claim 6, wherein said flywheel is decoupled from said member after pressing the workpiece or after reaching Bottom Dead Centre or thereabouts.

9. The method according to claim 1, wherein the second drive motor is accelerated after reaching bottom dead center or thereabouts or after pressing the workpiece.

10. The method according to claim 1, wherein the second drive motor or actuator speed is variably controlled to slow the press down upon reaching Unload Cam or thereabouts for a period of time for synchronization purposes and re-accelerate the press before reaching the Die Protect position or thereabouts of the next press cycle.

11. The method according to claim 1, wherein the second drive motor speed is variably controlled to operate the press in a Continuous operation without stopping the press between successive press cycles.

12. The method according to claim 1, wherein the second drive motor is decelerated from a deceleration position dependent on an unload cam angle of the press cycle.

13. The method according to claim 10, wherein the second drive motor is decelerated to a reduced speed or zero speed utilizing in part regenerative braking.

14. The method according to claim 1, further comprising:

providing a control output to the said drive control of the second drive motor to move said ram to a cycle start position for each press cycle which is a plurality of degrees of crank angle backwards in a second rotation direction from the previous prior press cycle stop position or zero-speed position.

15. The method according to claim 1, wherein the second drive motor is accelerated from a start up position of less than top dead center, or less than 0 degrees crank angle, in the first rotation direction during a first press cycle and accelerated from a start position of greater than top dead center, 360 degrees crank angle, during a second press cycle in the second rotation direction.

16. The method according to claim 14, wherein said motor is decelerated to a reduced speed or a zero speed utilizing in part regenerative braking.

17. The method according to claim 6, wherein said press is run with the flywheel disconnected during the whole press cycle and the second motor, or motor together with an inertia device, provide power to press the current workpiece.

18. A mechanical press, comprising:

a first electric drive motor, a drive control for controlling the first motor, a ram, a flywheel driven by the first motor, a clutch configured to connect the flywheel to the ram, a member for transmitting motion of said flywheel to linear motion of said ram, wherein the ram is arranged to be lowered and raised along a linear path for operating said press in a press production cycle, wherein the press production cycle compries a pressing part and one or more non-pressing parts, a second drive motor arranged connected to said ram, and a drive control for controlling the second drive motor arranged to provide a control output to vary the speed of said second drive motor during at least one part of said press cycle, wherein the wherein the second motor drives the press to a speed above a pressing speed prior to carrying out the press production cycle and slows the speed of the press down to a pressing speed at a pressing time, and wherein said second drive motor is reversed at the end of each complete press production cycle and driving the press in a second rotational direction with the second motor.

19. The mechanical press according to claim 18, wherein the control for controlling the second drive motor controls the speed of said second drive motor to vary during at least one said non-pressing part of the cycle and may be greater than the speed of said drive motor during said pressing part of the cycle.

20. The mechanical press according to claim 18, wherein said for transmitting motion to linear motion of said ram comprises any transmission type from the group of: crank, knuckle, link, cam, screw, ball screw, rack-type mechanism.

21. The mechanical press according to claim 18, wherein said second motor speed is variable and may be synchronised with the rotational speed of said flywheel before engaging the clutch or other coupling member at a time before the start of the pressing stage.

22. The mechanical press according to claim 18, wherein said press production cycle in a first rotation direction may be greater than 360 degrees and wherein the press motor is arranged to be reversed at the end of each said press production cycle.

23. The mechanical press according to claim 18, wherein said motor is arranged reversible and operable in either of a first or a second rotational direction.

24. The mechanical press according to claim 18, further comprising:

a position sensor for determining a crank rotation angle of the press and/or a position of said ram between top dead center and bottom dead center.

25. The mechanical press according to claim 18, wherein the press may be brought to a standstill during pressing at a position of bottom dead center or thereabouts.

26. The mechanical press according to claim 18, further comprising:

a measuring unit configured to measure a speed of said second drive motor.

27. The mechanical press according to claim 26, further comprising a measuring unit associated with a first and/or a second drive motor, or in a control unit, for measuring or otherwise determining the speed and/or position of said first and/or second drive motor or actuator.

28. The mechanical press according to claim 18, further comprising:

an energy regeneration unit for regenerating energy which is arranged to recover energy during braking or deceleration of second motor.

29. The mechanical press according to claim 18, wherein the torque of said second drive motor and/or first drive motor may be varied during at least one part of said press cycle.

30. The mechanical press according to claim 18, wherein at least one second motor or actuator of said press comprises any from the group of: a rotary motor, a linear motor, a hydraulic actuator.

31. A system, comprising:

at least one mechanical press comprising a first electric drive motor, a drive control for controlling the first motor, a ram, a flywheel driven by the first motor, a clutch configured to connect the flywheel to the ram, and a member for translating rotational motion of said flywheel to linear motion of said ram, wherein the ram is arranged to be lowered and raised along a linear path for operating said press in a production cycle, wherein the press production cycle comprises a pressing part and one or more non-pressing parts, a second drive motor or actuator arranged connected to said ram for transmitting motion of said flywheel to said ram of the at least one said press and such that a drive control of the second drive motor is arranged to provide a control output to vary the speed of said second drive motor during at least one part of said press cycle, and wherein the wherein the second motor drives the press to a speed above a pressing speed prior to carrying out the press production cycle and slows the speed of the press down to a pressing speed at a pressing time, and wherein said second drive motor is reversed at the end of each complete press production cycle and driving the press in a second rotational direction with the second drive motor, at least one device for loading and/or unloading of a workpiece, and at least one control unit.

32. The system according to claim 31, further comprising:

at least one control unit for monitoring and/or controlling a production or set-up operation of said press.

33. The system according to claim 31, wherein the at least one control unit comprises one or more computer programs for controlling the speed or torque of the second drive motor of the at least one press.

34. The system according to claim 31, further comprising:

an energy recovery unit for recovering energy from the second drive motor of the at least one press during deceleration or braking.

35. The system according to claim 31, further comprising:

an energy recovery unit for recovering energy from the second motor during deceleration or braking comprising any from the list of a: capacitor, battery, flywheel, first or other drive motor, compressible fluid reservoir.

36. A computer program product, comprising:

a computer readable medium; and computer program code recorded on the computer readable medium and executable by a processor to perform a method for operating a mechanical press comprising a first electric drive motor, a drive control for controlling the first motor, a ram, a flywheel driven by the first motor, a clutch configured to connect the flywheel to the ram, a second drive motor or actuator arranged to drive said ram, and a translating member for translating rotational motion of said flywheel in a first rotation direction into a linear motion of said ram, wherein said ram is arranged to be lowered and raised along a linear path for operating said press to carry out a press production cycle, wherein said press production cycle comprises a pressing part and one or more non-pressing parts, the method comprising controlling output of the press through controlling said second drive motor such that the speed of said second drive motor is varied during at least one part of said press production cycle, wherein the second motor drives the press in a first rotational direction to a speed above a pressing speed prior to carrying out the press production cycle and slows the speed of the press down to a pressing speed at a pressing time, carrying out the pressing with power at least from the flywheel, and reversing said second drive motor at the end of each complete press production cycle the press in a second rotational direction with the second drive motor.

37. The method according to claim 1, wherein the mechanical press is controlled to carry out a single stroke or continuous operation of any from the list of: stamping, hot stamping, pressing, deep drawing, cutting, punching.

38. The method according to claim 1, further comprising:

recovering energy from said press through regenerative braking.

39. The method according to claim 1, further comprising:

recovering energy from said press using the second motor;

storing the energy in an energy recovery module; and smoothing electrical power consumption of the press.

40. The method according to claim 1, further comprising:

recovering energy from the second motor;

storing the energy in the flywheel with the first drive motor of the press.

41. The mechanical press according to claim 18, further comprising:

at least one computer program stored in a control and comprising computer program instructions for making a processor perform a method for controlling the press to optimize the press cycle time.

42. The system according to claim 31, wherein the at least one control unit comprises at least one computer program program stored in a processor or in a memory storage element for controlling the press to optimize the press cycle time.

43. The system according to claim 31, wherein the at least one control unit comprises at least one computer program program stored in a processor or in a memory storage element for controlling the press to optimize a peak power use of a press cycle.

44. The system according to claim 35, further comprising:

a single rectifier configured to create a DC-link voltage for the first motor and the second motor.

45. The system according to claim 31, wherein the press is configured to carry out at least one operation selected from the group comprising stamping, hot stamping, pressing, deep drawing, cutting or punching.

46. A method for operating a mechanical press comprising a first electric drive motor, a drive control for controlling the first motor, a ram, a flywheel driven by the first motor, a clutch configured to connect the flywheel to the ram, a second drive motor or actuator arranged to drive said ram, and a translating member for translating rotational motion of said flywheel in a first rotation direction into a linear motion of said ram, wherein said ram is arranged to be lowered and raised along a linear path for operating said press to carry out a press production cycle, wherein said press production cycle comprises a pressing part and one or more non-pressing parts the method comprising:

driving the flywheel to a pressing speed with the first motor;

controlling output of the press through controlling said second drive motor such that the speed of said second drive motor is varied during at least one part of said press production cycle;

engaging the clutch to connect the flywheel to the ram, wherein a speed of the second motor is synchronized with a rotational speed of said flywheel before engaging the clutch or other coupling member before the pressing stage such that there is substantially no torque on the clutch when the clutch is engaged;

carrying out the pressing with power at least from the flywheel;

disengaging the clutch to disconnect the flywheel from the ram; and reversing said second drive motor at the end of each complete press production cycle and driving the press in a second rotational direction with the second drive motor.

* * * * *